US006527268B2

(12) United States Patent
Spurk

(10) Patent No.: US 6,527,268 B2
(45) Date of Patent: Mar. 4, 2003

(54) METHOD AND DEVICE FOR CONTACT-FREE GUIDANCE OF SHEETS

(75) Inventor: Joseph Hubert Spurk, Bad König (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/836,813

(22) Filed: Apr. 17, 2001

(65) Prior Publication Data

US 2001/0038177 A1 Nov. 8, 2001

(30) Foreign Application Priority Data

Apr. 17, 2000 (DE) ..... 100 18 922

(51) Int. Cl.[7] ..... B65H 29/24
(52) U.S. Cl. ..... 271/195; 271/204
(58) Field of Search ..... 271/194, 195, 271/204; 406/86, 87, 88; 226/97

(56) References Cited

U.S. PATENT DOCUMENTS 3,385,490 A * 5/1968 Malmgren et al. ..... 406/88
5,927,203 A * 7/1999 Gieser et al. ..... 271/195
6,027,112 A * 2/2000 Guenther et al. ..... 271/195
6,039,316 A * 3/2000 Jackson et al. ..... 371/195
6,361,041 B2 * 3/2002 Stephan ..... 271/195

FOREIGN PATENT DOCUMENTS

DE 1 474 214 10/1970
DE 34 11 029 C2 10/1987

* cited by examiner

*Primary Examiner*—H. Grant Skaggs
(74) *Attorney, Agent, or Firm*—Laurence A. Greenberg; Werner H. Stemer; Gregory L. Mayback

(57) ABSTRACT

A method for feeding sheets in a feeding direction along a guide face of a sheet guiding device in a sheet processing machine includes forming an air cushion between the guide face and a respective sheet by providing an air pressure distribution resulting in air flows beneath the respective sheet. The air pressure distribution is based virtually only on the effect of viscosity of the flowing air and is then capable of carrying the sheet; a device for performing the method; and a sheet processing machine such as a printing machine including the device.

36 Claims, 3 Drawing Sheets

METHOD AND DEVICE FOR CONTACT-FREE GUIDANCE OF SHEETS

BACKGROUND OF THE INVENTION

Field of the Invention

The invention relates to a method for contact-free guidance of sheets wherein, in a sheet processing machine, the sheets are fed in a feeding direction along a guide face of a sheet guiding device providing an air cushion between the guide face and the respective sheet. The invention is also directed to a device for feeding sheets along a guide face of a sheet guiding device of a sheet processing machine having air flow openings provided in the guide face for creating an air cushion between the guide face and the respective sheet. Furthermore, the invention relates to a sheet processing machine, in particular, a printing machine, equipped with the device according to the invention.

Methods and devices of the foregoing types are used especially in transporting sheets between successive stations of sheet processing machines. This may involve two successive printing units of a multi-color printing machine, or one printing unit and a following delivery system of a single-color or multi-color printing machine. Devices of the foregoing general type are associated in particular with conveyor systems, usually embodied as chain conveyors, for transporting the sheets to a stacking or pile station. Those devices, in general, have devices for creating an air cushion between the guide face and the sheets.

In a device heretofore known from the published German Patent Document DE 34 11 029 C2, the guide face has air flow openings with a minimum diameter of 15 mm, in an arrangement such that the total cross-sectional area of the air flow openings makes up a proportion of 15 to 30% of the total area of the guide face. At an air pressure of approximately 80 pascals, the air flow openings generate a high volumetric flow of about 1200 $m^3/h$. For guiding sheets printed on one side, provision is made for connecting some of the air flow openings to a negative-pressure generator. A disadvantage of this device is that the sheets being fed, depending upon the mode of operation, make more or less major fluttering motions, which, for freshly printed sheets, on the one hand, can impair the quality of the printed image and, on the other hand, is associated with unwanted noise. Furthermore, relatively powerful blowers are required, which take up space and at the same time contribute to producing noise.

SUMMARY OF THE INVENTION

It is accordingly an object of the invention to overcome the foregoing disadvantages of the aforedescribed prior art by providing, in particular, largely flutter-free sheet guidance.

With the foregoing and other objects in view, there is provided, in accordance with one aspect of the invention, a method for feeding sheets in a feeding direction along a guide face of a sheet guiding device in a sheet processing machine, which comprises forming an air cushion between the guide face and a respective sheet by providing an air pressure distribution resulting in air flows beneath the respective sheet, the air pressure distribution being based virtually only on the effect of viscosity of the flowing air and being then capable of carrying the sheet.

In accordance with another mode, the method of the invention includes producing the air flows by pressure sources and pressure sinks having flow course lengths therebetween which are short compared to the dimension of the respective sheet in the direction of a respective one of the air flows.

In accordance with a further mode, the method of the invention includes providing an alternating sequence of pressure sources and pressure sinks in at least one direction parallel to the guide face.

In accordance with an added mode, the method of the invention includes providing the alternating sequence of pressure sources and sinks in the feeding direction.

In accordance with an additional mode, the method of the invention includes providing, in the region of at least some of the pressure sinks, at least one of a prevailing atmospheric pressure and a prevailing pressure other than atmospheric pressure.

In accordance with yet another mode, the method of the invention includes, in the region of at least some of the pressure sinks, actively removing air from the air cushion by suction.

In accordance with yet a further mode, the method of the invention includes subjecting the pressure sources to compressed air so that, at a respective one of the pressure sources, a volumetric flow in $m^3/h$ is adjusted to less than 1% of the weight per unit of surface area, in $g/m^2$ of the sheet.

In accordance with yet an added mode, the method of the invention includes producing an air pressure adapted to the weight per unit of surface area of the sheet in the region of the pressure sources.

In accordance with yet an additional mode, the method of the invention includes setting the air pressure in the region of the pressure sources to from 1.5 to 4 times the weight per unit of surface area.

In accordance with still another mode, the method of the invention includes setting the air pressure in the region of the pressure sources to approximately twice the weight per unit of surface area.

In accordance with still a further mode, the method of the invention includes producing, in the region of the pressure sources, an air pressure of less than approximately 50 pascals.

In accordance with still an added mode, the method of the invention includes producing, in the region of the pressure sources, an air pressure between 0.5 and approximately 5 pascals.

In accordance with another aspect of the invention, there is provided a device for feeding sheets in a sheet-feeding direction along a guide face of a sheet guiding device of a sheet processing machine, the guide face comprising air flow openings formed therein for producing an air cushion between the guide face and a respective sheet, the air flow openings being distributed over the guide face and being formed, in part, as blast openings for feeding air into the air cushion and, in part, as outflow openings for releasing air from the air cushion, and being disposed alternatingly in at least one direction parallel to the guide face.

In accordance with another feature of the invention, the blast openings and the outflow openings are disposed alternatingly in a direction parallel to the sheet-feeding direction.

In accordance with a further feature of the invention, the air flow openings have a total cross-sectional area equal to less than 15% of the surface area portion of the guide face formed with the air flow openings.

In accordance with an added feature of the invention, the total cross-sectional area of the air flow openings equals between approximately 1% and approximately 10% of the portion of surface area of the guide face formed with the air flow openings.

In accordance with an additional feature of the invention, the total cross-sectional area of the air flow openings equals between approximately 2% and approximately 3% of the portion of surface area of the guide face formed with the air flow openings.

In accordance with yet another feature of the invention, the air flow openings are formed of at least one of holes and slits.

In accordance with yet a further feature of the invention, the air flow openings are formed as holes having a diameter of less than 15 mm.

In accordance with yet an added feature of the invention, the diameter is between approximately 1 mm and approximately 10 mm.

In accordance with yet an additional feature of the invention, the air flow openings formed as slits extend transversely to the sheet-feeding direction.

In accordance with still another feature of the invention, mutually adjacent air flow openings have a mean spacing therebetween of less than 25 mm.

In accordance with still a further feature of the invention, the mean spacing between the mutually adjacent air flow openings is between approximately 5 mm and approximately 20 mm.

In accordance with still an added feature of the invention, more than 30% of the air flow openings serve as blast openings, and less than 70% of the air flow openings serve as outflow openings.

In accordance with still an additional feature of the invention, approximately 50% of the air flow openings serve as blast openings, and approximately 50% of the air flow openings serve as outflow openings.

In accordance with another feature of the invention, at least one of atmospheric pressure and a pressure other than atmospheric pressure prevails in the region of the outflow openings.

In accordance with a further feature of the invention, at least some of the outflow openings are connected to a negative-pressure generator.

In accordance with an added feature of the invention, the sheet-feeding device includes a device for controlling the pressure in the air cushion as a function of the weight per unit of surface area of the respective sheets.

In accordance with an additional feature of the invention, the sheet-feeding device includes a device for selectively deactivating at least some air flow openings disposed in one of the feeding direction and a direction transverse thereto.

In accordance with yet another feature of the invention, the width of the air cushion transversely to the feeding direction is settable by activation and deactivation, respectively, of air flow openings disposed in the feeding direction.

In accordance with yet a further feature of the invention, the sheet-feeding device includes a device for controlled activation and deactivation, respectively, of air flow openings in the region between sheets following one another in the feeding direction.

In accordance with another aspect of the invention, there is provided a sheet processing machine including a device for feeding sheets in a sheet-feeding direction along a guide face of a sheet guiding device of the sheet processing machine, the guide face comprising air flow openings formed therein for producing an air cushion between the guide face and a respective sheet, the air flow openings being distributed over the guide face and being formed, in part, as blast openings for feeding air into the air cushion and, in part, as outflow openings for releasing air from the air cushion, and being disposed alternatingly in at least one direction parallel to the guide face.

In accordance with a concomitant aspect of the invention, there is provided a printing machine including a device for feeding sheets in a sheet-feeding direction along a guide face of a sheet guiding device of the printing machine, the guide face comprising air flow openings formed therein for producing an air cushion between the guide face and a respective sheet, the air flow openings being distributed over the guide face and being formed, in part, as blast openings for feeding air into the air cushion and, in part, as outflow openings for releasing air from the air cushion, and being disposed alternatingly in at least one direction parallel to the guide face.

In terms of the method, the object of the invention is attained by forming the air cushion through an air pressure distribution, based essentially exclusively upon the effect of the viscosity of the flowing air, which lead to air flows underneath the respective sheet, the air pressure distribution being capable of precisely supporting the sheet at the then time, i.e., bearing the weight thereof.

The pressure underneath the sheet is accordingly kept within the range of a lower limit, which still precisely assures a spacing of a few millimeters, such as about 2 mm, between the guide face and the sheet in order to enable guidance without smearing. To build up the air cushion, which is more comparable to a lubricant film, flows are created wherein the influence of the internal friction in the flowing medium, which is known to be proportional to the dynamic viscosity of the flowing medium and the speed gradient in the region through which the flow takes place, predominates over the influence of inertia of the flowing medium, which is proportional to the density of the medium and to the square of the flow velocity. In other words, flows with a relatively low Reynolds number are created, wherein forces of inertia in the flowing medium play a subordinate role in comparison with viscosity forces. It has surprisingly been demonstrated that when such conditions are established, a largely flutter-free sheet guidance can be achieved.

This can possibly be explained as follows: In the heretofore known devices of this general type (note the published German Patent Document DE 34 11 029 C2), it can be concluded from the indications of the total cross-sectional area of the air nozzles at the guide face and the volumetric flow and the feed pressure, that the air flow supporting the sheet is a flow with a relatively high Reynolds number. In such cases, the air cushion is created primarily by the forces of inertia of the air, i.e., the sheet rides on the air stream, as it were. Because considerably more air leaves through the air nozzles than is needed to support the sheet, the majority of the forces introduced into the air cushion are intercepted by inertial reactions of the sheet, which leads to an uncontrolled and uncontrollable fluttering motion of the sheet. Because, in the method, in fact, considerably more air is blown in than is needed to support the sheet, it can be concluded that the feed pressure of about 80 pascals that is considered necessary is considerably higher than the typical weight per unit of surface area of sheets, in the application described. The procedure of this conventional method has the disadvantage not only of the unavoidable fluttering motion but also of high air consumption, as well as the disadvantage mentioned hereinbefore of considerable noise production. Contributing to this effect is not only the fluttering motion of the sheet material itself, but also aerodynamically generated sound reflected by the turbulence in the air streams carrying the sheet. The turbulence is promoted by the fact that in the aforementioned flows with a high Reynolds number, turbulence in the flowing medium is favored.

The invention avoids these problems by largely dispensing with the action of dynamic forces of the flowing medium, and the supporting function is achieved primarily by way of the viscosity of the flowing medium. To attain this supporting action, air consumption can be considerably lower than in the prior art. Because, furthermore, the forces of inertia in the air do not play any considerable role, undesired inertial reactions of the sheet, especially sheet fluttering, are reliably avoided, as well. In addition, air flows created according to the invention are, for the most part, free of turbulence, which contributes decisively to quiet operation.

In terms of the sheet-feeding device of the invention, the object of the invention is attained by the fact that air flow openings are distributed over the guide face and formed, in part, as blast or blow openings for feeding air into the air cushion and, in part, as outflow openings for releasing or letting air out of the air cushion, and are disposed alternatingly in at least one direction parallel to the guide face.

The blast openings serve as pressure sources, and the outflow openings disposed in alternation therewith serve as pressure sinks. The air flow openings are disposed so that blast openings and outflow openings alternate with one another many or multiple times in at least one direction parallel to the guide face, and in particular in terms of the length defined in this direction of the guided sheet. Because of this multiple alternating arrangement, assurance is provided that the air fed into the region of a blast opening flows out immediately again, at least in part through one or more closely adjacent pressure sinks, and thus the undesired inertial reactions of the sheet cannot occur. Furthermore, what is achieved is that significant outflow of air occurs in the peripheral regions of the guided sheet, an outflow that could lead to the generation of fluttering motions and smearing. Compared to the total area of the sheet, pressure equalization takes place over a relatively small area, in that, within the air film, relatively short flow paths are created having a length which is small in comparison with the size of the sheet in the direction of a respective one of the air flows.

The term "air" represents, in general, in the context of the invention, all gases suited as a flowing medium for load-bearing cushions.

Preferably, the blast openings and outflow openings are disposed so as to alternate with one another many times at least in the feeding direction. As an alternative, but preferably in addition, an alternating arrangement of pressure sources and pressure sinks transversely to the feeding direction can be provided.

Preferred refinements are distinguished in that the air flow openings have a total cross-sectional area that amounts to less than 15%, in particular between 1% and approximately 10%, and preferably between 2% and approximately 3% of the surface area portion of the guide face provided with the air flow openings. In practical terms, this can be attained by a relatively close distribution of the air flow openings, which have a very small diameter, for example, of markedly less than 15 mm; preferably, the diameter is between 1 and 10 mm. A favorable tight pattern is obtained whenever adjacent air flow openings have a mean spacing that is less than 25 mm, and in particular is between about 5 mm and about 20 m.

The air flow openings can be at least approximately circular openings, formed, for example, by bores in a sheet guide plate or baffle. As an alternative or in addition, slitlike air flow openings can be provided, which preferably extend transversely to the feeding direction of the sheets. The pressure sources, in the first case, are bounded circularly and, in the second case, linearly. This is true as well for the pressure sinks. It is also possible for different geometries to be provided for the pressure sources and the pressure sinks.

Especially if the distribution of air flow openings is advantageously close, it is expedient if more than 30% and, in particular, approximately 50% of the air flow openings serve as blast or blow openings, and less than 70% and, in particular, approximately 50% of the air flow openings serve as outflow openings. Especially if an approximately equal number of blast openings and outflow openings located relatively close together and alternating with one another is provided, the described arrangement of alternating pressure sources and pressure sinks in a tight pattern can be achieved, which allow the buildup of a lubricant filmlike air cushion.

Because, in the devices according to the invention, the load-bearing action of the air cushion is accomplished primarily by the viscosity of the flowing medium and not by the forces of inertia thereof, work can be performed with relatively low air consumption. It has proved especially advantageous if the air flow openings intended as pressure sources are subjected to compressed air so that a very slight volumetric flow is created. Per pressure source, the volumetric flow in $m^3/h$ should be set to less than 1% of the weight per unit of surface area of the sheet, in $g/m^2$.

The pressure at the air flow openings serving as pressure sources will expediently be selected as low and should amount to less than about 50 pascals, and especially should be between about 0.5 and about 5 pascals. With respect to the weight per unit of surface area or paper weight of the sheet material, it has proved advantageous if the pressure in the air cushion is adapted to this weight per unit of surface area in such a way that it amounts to approximately 1.5 times the weight per unit of surface area and preferably about twice the weight per unit of surface area. This has proved to be entirely adequate for reliably contact-free guidance which furthermore requires little air and reliably avoids fluttering motions of the sheet.

In a preferred embodiment, the outflow openings intended as pressure sinks are open towards the surroundings of the device, in particular, so that in the region of the pressure sinks, primarily ambient pressure prevails which, as a rule, is atmospheric pressure, but need not be. That is, these can be "passive" pressure sinks, which can be realized structurally especially economically. Alternatively or in addition, in the region of the pressure sinks, air can be removed by suction from the filmlike air cushion, because the air flow openings are capable of discharging, for example, into flow channels connected to one or more negative-pressure generators. The removal by suction can be intended, in particular, for overcoming line losses in the flow channels associated with the outflow openings, so that the desired pressure can be set in the region of the pressure sinks.

A preferred improvement is offered by a device for controlling the pressure in the air cushion as a function of the weight per unit of surface area of the sheets. As a result, the air consumption can be adapted to the sheet properties, so that the load-bearing conditions can be set individually for each sheet weight and at the same time work can be performed with the least possible air consumption.

A further version provides that devices for selective deactivation of individual rows of air flow openings are provided; such rows can extend either in the sheet feeding direction and/or transversely thereto. As a result, especially in conjunction with controlling the air cushion pressure, it is possible to adapt the distribution of the effective pressure sources and pressure sinks to the stiffness of the sheets. For example, the adaptation can be performed so that, with relatively stiff sheets, the mean spacing between pressure sources and associated pressure sinks is selected to be greater than with sheets of lesser stiffness. By deactivating or activating peripheral rows extending in the feeding direction, the width of the air cushion can also be adjusted.

In an improvement that is distinguished by especially trouble-free operation, a device for automatic, temporary deactivation of air flow openings is provided in the region between successive sheets in the feeding direction; by way of example, this device deactivates the air flow openings which, at a given time, are located between the trailing edge of a sheet and the leading edge of a subsequent sheet, and re-activates them after the gap between the sheets has passed. The deactivated region preferably follows the motion of the sheets along the guide face. Correspondingly, in terms of control, such a device can take the speed of the conveyor system into account.

The invention furthermore relates to a sheet processing machine, which is equipped with a device of the aforementioned type and/or operates by the aforementioned method, such as a printing machine, in particular.

Other features which are considered as characteristic for the invention are set forth in the appended claims.

Although the invention is illustrated and described herein as embodied in a method and device for contact-free guidance of sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
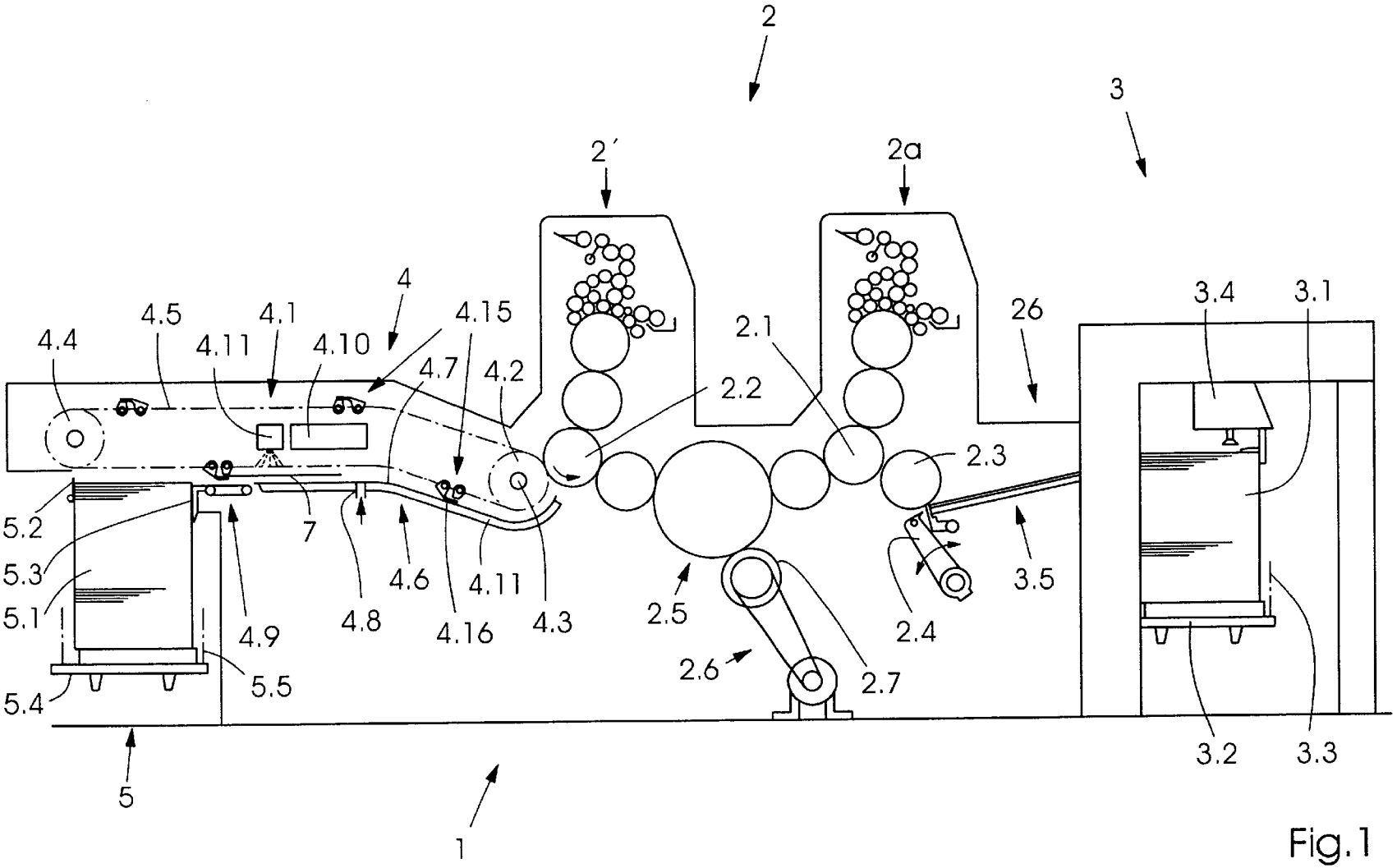
FIG. 1 is an overall diagrammatic side elevational view of an embodiment of a sheet processing machine, such as an offset printing machine, for example, incorporating the guiding device according to the invention.

Referring now to the drawings and, first, particularly to FIG. 1 thereof, there is shown therein a diagrammatic overview of a sheet processing machine 1. This machine has a printing unit section 2 and, at the input side thereof, a sheet feeding system 3 in the form of a feeder, and on the output side, a delivery system 4 with a chain conveyor 4.1, below which there is located a stacking or pile station 5 for sheets which have been processed.

The sheet feeding system 3 has a platform 3.2 that supports a sheet pile 3.1. For intermittently raising the platform 3.2, as the sheets are drawn from the pile 3.1, a lifting mechanism is provided, which engages the platform 3.2, for example, by hoisting chains 3.3.

Above the pile 3.1, a separation or singling unit 3.4 with lifting and dragging suction devices for gripping whichever is the topmost sheet in the pile 3.1 and transferring this sheet to a transport unit 3.5, embodied as a suction belt conveyor, is provided, which orients the sheets on the leading and on a side edge thereof for further passage.

The printing unit section 2 in the exemplary embodiment shown has two printing units 2*a* and 2' which, here, by way of example, operate in accordance with the offset printing method.

The printing unit 2*a* is preceded by a feed drum 2.3, which transfers the sheet, to be printed in the respective printing unit, to the printing cylinder 2.1 of this printing unit 2*a*.

A pre-gripper 2.4 is disposed between the transport unit 3.5 and the feed drum 2.3, and takes over a respective sheet 7 from the transport unit 3.5 and transfers it to the feed drum 2.3, which then transfers it to the printing cylinder 2.1 of the first printing unit 2*a*.

A sheet transfer device 2.5 is provided between the printing units 2*a* and 2'. If two printing units connected by such a sheet transfer device 2.5 both print the same side of a sheet, with different colors, the sheets are then transferred non-reversed to the printing cylinder 2.2 of the printing unit 2' by the transfer device; if each of the printing units prints a different side of a sheet, then the corresponding sheet transfer device is constructed so as to transfer the sheets reversed or turned-over to the subsequent printing unit 2'.

For operating the machine, a drive system 2.6 is provided, which has a motor-driven belt drive and a driven gearwheel 2.7 meshing with a gearwheel of the sheet transfer device 2.5. In the case at hand, all the components of the printing machine which are involved in loading or feeding the printing machine with the sheets 7 and in carrying away the processed sheets 7, are operatively connected to the drive 2.6.

The sheets 7 leaving the printing unit 2' are transferred to the chain conveyor 4.1 of the delivery system 4 which, as noted, is operatively connected to the drive 2.6. To that end, a gearwheel for driving drive sprocket wheels 4.2, secured to a common sprocket wheel shaft 4.3, is assigned to these sprocket wheels and meshes with a train of gearwheels that drives the cylinders of the two printing units 2*a* and 2', the feed drum 2.3, and the drum and cylinder assembly forming the sheet transfer device 2.5.

The chain conveyor 4.1 includes two conveyor chains 4.5, each of which revolves along a respective long side of the delivery system. Each conveyor chain 4.5 is looped around one of the drive sprocket wheels 4.2, respectively, and, in the example at hand, is guided via a respective deflection sprocket wheel 4.4. Gripper systems 4.15 with grippers 4.16 supported by the two conveyor chains 4.5 extend between the conveyor chains 4.5; the gripper systems 4.15 pass through gaps between grippers disposed on the printing cylinder 2.2 and, in that regard, take over a sheet 7, with one edge of the gripper engaging the leading edge of the sheet 7, immediately before the gripper disposed on the printing cylinder 2.2 opens.

In the exemplary embodiment shown in FIG. 1, the sheets 7 are transported by the lower run of the chain conveyor 4.1. A sheet guiding device 4.6 formed with a sheet guide face 4.7 is associated with the chain conveyor 4.1 and follows alongside the course of the path of the lower strands which transport the sheets 7. Between the guide face 4.7 and whichever sheet 7 is being guided therealong, an air cushion is formed. To that end, the sheet guiding device is equipped with air flow openings, which discharge into the guide face 4.7, some of the airflow openings serving as blast or blow openings 4.8 and some serving as outflow openings 4.8' (note FIG. 2). In FIG. 1, only one blast opening 4.8 is shown, in symbolic form, as representative of all of the air flow openings 4.8 and 4.9'. The structure and mode of operation of the devices for generating the load-bearing air cushion are described hereinafter.

To prevent the printed sheets 7 from adhering or sticking together after being stacked in sheet piles 5.1, a dryer 4.10 and a powder applicator 4.11 are provided along the way taken by the sheets 7 from the drive sprocket wheels 4.2 to a sheet brake 4.9. This sheet brake 4.9 includes a plurality of braking modules, which are embodied in FIG. 1 by suction belt conveyors.

From the chain conveyor 4.1, the sheets 7 are transferred to the stacking or pile station 5, where a pile 5.1 of processed sheets forms. In an upper receiving region for the sheets 7, the stacking or pile station 5 has a front edge stop 5.2 and an opposed rear edge stop 5.3, which serve for aligning the sheets 7. The stacking or pile station 5 also has a lifting mechanism, of which FIG. 1 shows only a platform 5.4, supporting the pile 5.1, and hoisting chains 5.5 engaging the platform 5.4.

The machine 1 described thus far functions as follows:

The sheets 7 are taken from the sheet pile 3.1 by the separation or singling unit 3.4 and transferred to the transport unit 3.5. The transport unit 3.5 transfers the sheet to the pre-gripper 2.4, which, in turn, carries it to the feed drum 2.3. The sheet is then passed through the printing units **2*a* and 2' via the printing cylinders 2.1 and 2.2 and the sheet transfer device 2.5** and printed in the process.

The grippers 4.16 of a gripper system 4.15, respectively, moving past the printing cylinder 2.2, take over a respective sheet 7 and transport it floatingly in a direction towards the stacking or pile station 5; an air cushion formed between the guide face 4.7 and the sheet 7 assures contact-free guidance of the sheet 7 at a spaced distance from the guide face.

For depositing the sheet 7 in the pile 5.1, the grippers 4.16 of a gripper system 4.15 open and transfer the sheet 7 to the sheet brake 4.9. The sheet brake 4.9 imparts a deposition speed to the sheet 7 that is reduced compared to the processing speed and, after the sheet 7 has reached the deposition speed, the sheet brake 4.9 releases it, so that finally, in the stacking or pile position 5, a correspondingly decelerated sheet 7 meets or runs onto the front or leading edge stops 5.2 and, being aligned thereat and at the opposed rear or trailing edge stops 5.3, the sheet is deposited on the pile 5.1.

Figure 2:
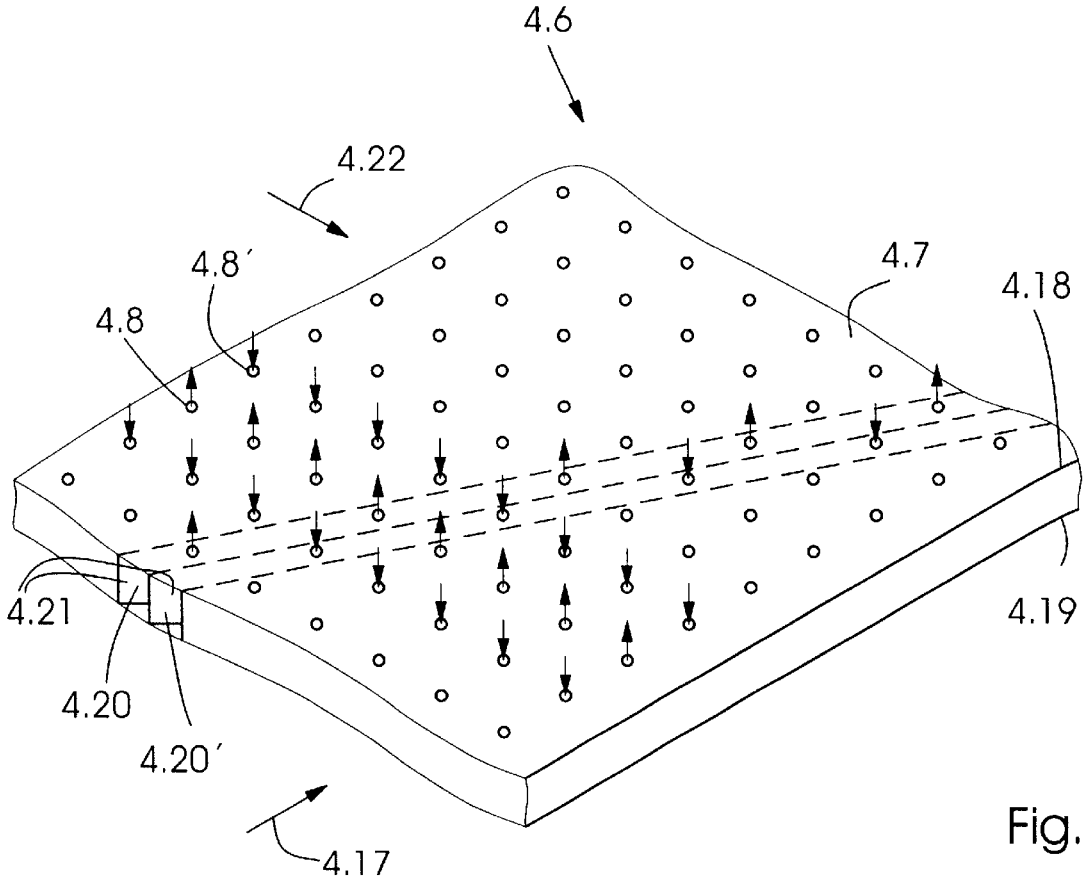
FIG. 2 is an enlarged fragmentary view of FIG. 1, showing, in a perspective illustration, a detail of a first embodiment of the guiding device, without sheets.

FIG. 2 is a diagrammatic oblique perspective view of the guide face 4.7 of the sheet guiding device 4.6 of FIG. 1. The width of the guide face only slightly exceeds the width of the sheet guided in the processing and feeding direction 4.17, respectively. The guide face 4.7 is formed by the top side of a sheet guide baffle or plate 4.18, which is disposed above a base plate 4.19 of the sheet guiding device 4.6. Between the sheet guide plate 4.18 and the sheet base plate 4.19, flow channels are formed, of which, in the interest of simplicity, only two flow channels 4.20 and 4.20' are shown, extending at an angle of about 45° to the feeding direction 4.17 and parallel to one another. The flow channels are bounded at the top and bottom by the sheet guide plate or baffle 4.18 and the sheet base plate 4.19 and, laterally, by partition baffles or plates 4.21 connecting the guide plate or baffle 4.18 and the base plate 4.19. The flow channels 4.20 are connected to at least one blower, and with the exception of air flow openings of the sheet guide baffle 4.18, they can be airtightly closed off. The air flow-through openings represent blast or blow openings 4.8, which are formed in the sheet guide plate or baffle 4.18. Flow channels 4.20' of equal size, being purely outflow conduits or channels, are open to the surroundings of the device.

The sheet guide plate or baffle 4.18 and the guide face 4.7, respectively, in the embodiment shown, have a distribution of air flow openings 4.8 and 4.8', which are arranged in a square pattern, with a pattern size in the range of 5 cm, so that the openings form straight rows of holes disposed parallel to the feeding direction 4.17. The air flow openings, not shown to scale, formed as bores in the sheet guide plate or baffle 4.18 and thus bounded circularly, can have a circular cross section of relatively small diameter, such as 8 mm, so that the total cross-sectional areas of the air flow openings amount to only a few percent, preferably between 2% and 3%, of the total area of the sheet guide plate or baffle 4.18.

Approximately half of the air flow openings, namely those that are assigned to a respective flow channel 4.20, are subjected by the non-illustrated blower to blowing or blast air; a relatively slight volumetric flow, for example, of less than 30 $m^3/h$, can be set. The air flow-through openings serving as blow or blast openings 4.8 act as "pressure sources", from which air exits in the direction of the upwardly-directed arrows, perpendicularly to the guide face 4.7, into the region above the sheet guide baffle or plate 4.18 for forming an air cushion between the latter and the sheet guided thereabove. The exit pressure is expediently set so that it amounts to only about twice the weight per unit of surface area of the sheet 7. It is preferably in the range of about 0.8 to about 5 pascals.

The other half of the air flow openings, namely those assigned to the flow channels 4.20', act as "pressure sinks" and outflow openings 4.8', respectively. Through them, air fed to the air cushion flows back into the surroundings, wherein, in particular, atmospheric pressure can prevail. In the example shown, the pressure sinks are passive, i.e., they are not connected to a suction removal system. To overcome line losses or in general to make the air cushion more uniform, a negative-pressure generator can also be connected to the flow channels 4.20'.

As a result of the described arrangement, rectilinear rows of holes are created both in the feeding direction 4.17 and transversely thereto; in these rows, directly adjacent air flow openings form pressure sources and pressure sinks alternatingly. Accordingly, in one row of holes, a pressure source is followed immediately by a pressure sink, which is then followed again by a pressure source, at the same spaced distance. This assures that the air exiting in the region of a pressure source for the most part flows through immediately adjacent pressure sinks, as is diagrammatically indicated in FIG. 3. Thus, between the guide face 4.7 and the guided sheet 7, pressure-equalizing flows (symbolized by arrows 4.23) are created, each with a short flow path which amounts to only a few percent of the length of the sheet 7 in the respective flow direction. Because the air thus fed, at least to a large extent, exits immediately again through closely adjacent pressure sinks, undesired inertial reactions of the sheet, which would make themselves felt in fluttering of the sheet, are reliably avoided. This is especially true because of the advantageously slight exit pressure in the blow or blast openings 4.8, which is typically less than 10 pascals. Practically only because of the viscosity action and viscosity, respectively, of the air, a matrixlike pressure distribution, corresponding to the pattern of air flow openings, of pressure sources and pressure sinks is created, which is just precisely capable of supporting the sheet 7.

Figure 4:
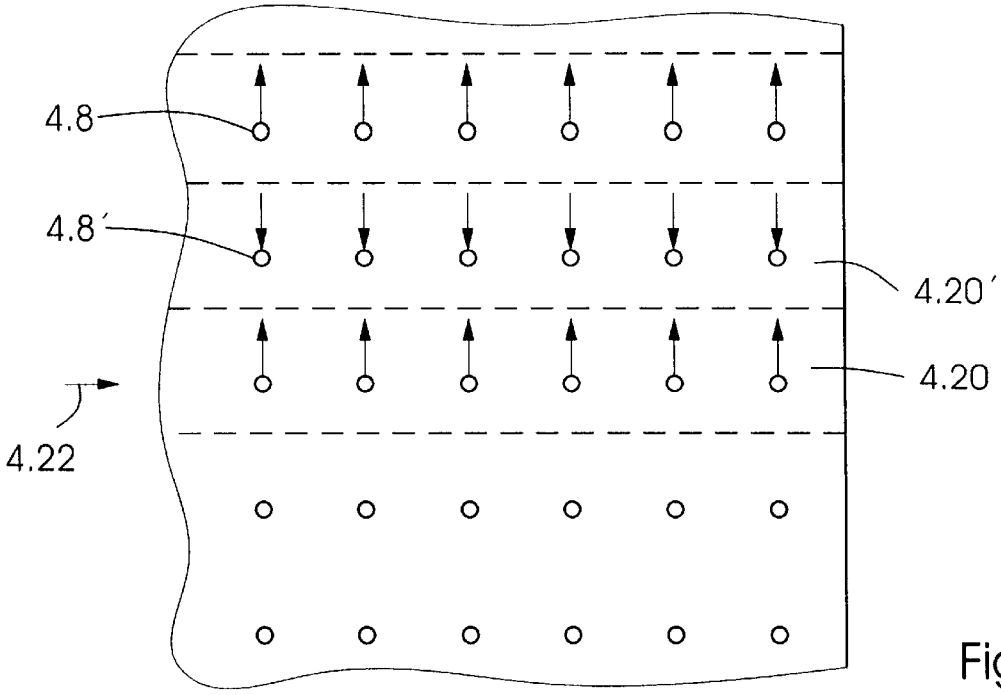
FIG. 4 is a fragmentary plan view of a second embodiment of the guiding device.

FIG. 4 shows a different embodiment of the invention, again with circularly bounded pressure sources and pressure sinks, which differs from the embodiment shown in FIG. 2 primarily in the course of the flow channels 4.20 and 4.20' and, thus, in the distribution of pressure sources and pressure sinks. In this embodiment, the flow channels 4.20 and 4.20', indicated by broken lines, extend transversely to the feeding direction 4.17, so that in the rows of holes extending transversely, all the air flow openings act as pressure sources or as pressure sinks. Viewed in the feeding direction 4.17, however, an alternating arrangement occurs again, wherein a pressure source is followed directly by a pressure sink, which is then directly followed by a pressure source again. The arrows, provided so as to show the pressure sources and pressure sinks more clearly, are collapsed into the plane of the drawing, as also in FIG. 5.

Figure 3:
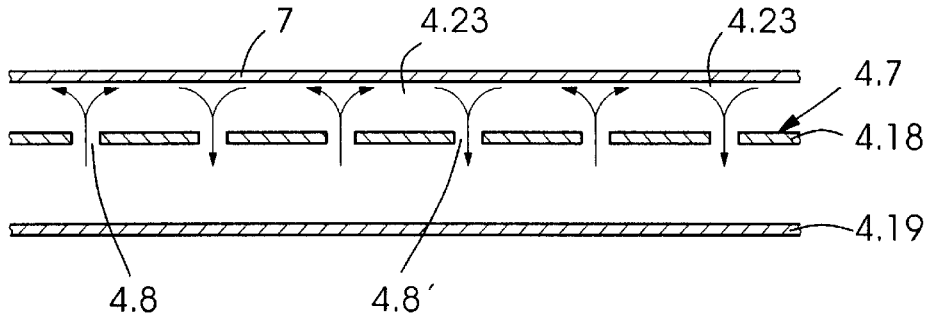
FIG. 3 is a vertical cross-sectional view of FIG. 2, showing a sheet in motion above the guiding device.
Figure 5:
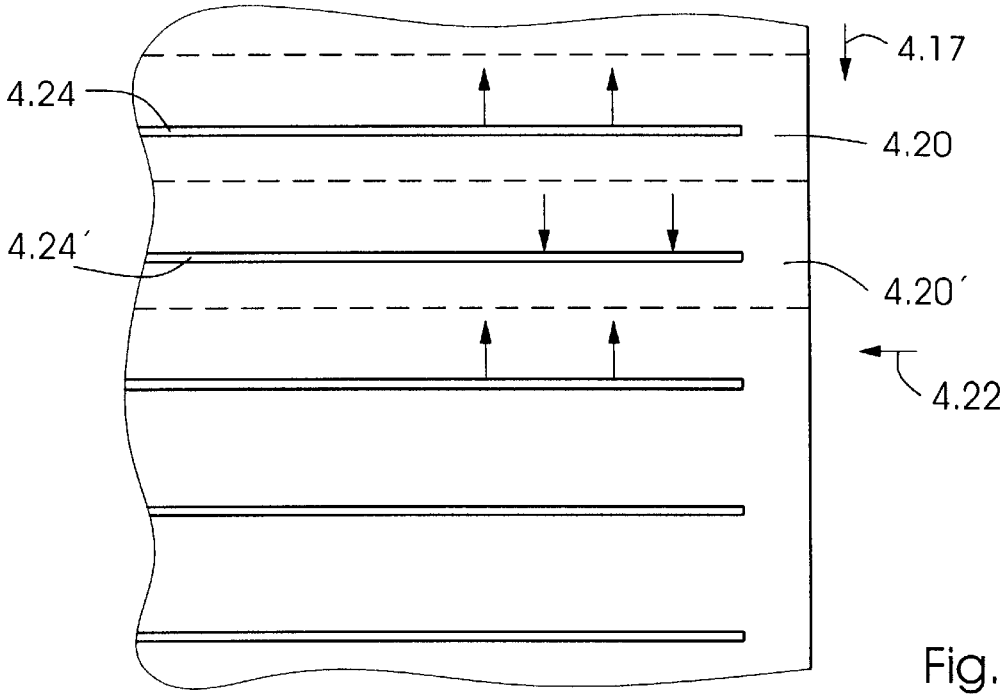
FIG. 5 is a view like that of FIG. 4 of a third embodiment of the guiding device.

While in the versions shown in FIGS. 2, 3 and 4, primarily small-area, circularly bounded pressure sources and pressure sinks are created, in the embodiment of FIG. 5, elongated pressure sources and pressure sinks are provided. In this embodiment, the sheet guide baffle or plate 4.18 has many continuous air flow openings 4.24, 4.24', formed as slits and extending in the transverse direction 4.22 nearly to the long edges of the sheet guide baffle; these air flow openings succeed one another in the feeding direction 4.17 at a slight spacing, such as 5 cm. In the feeding direction 4.17, an elongated pressure source is followed by an equally elongated pressure sink, which, in turn, is followed by another elongated pressure source. The air emerging from air flow openings which form blow or blast slits 4.24 is carried away again in the region of immediately adjacent air flow openings which form outflow slits 4.24' or pressure sinks. This creates a primarily washboardlike pressure distribution in the air cushion.

The embodiments described, along with other devices equipped in accordance with the invention, can be employed especially advantageously for contact-free guidance of printed sheets in single-color or multicolor printing machines, and as a result of alternatingly arranged, circularly bounded and/or elongated pressure sources and pressure sinks, they furnish a filmlike air cushion, which enables flutter-free sheet guidance with little air consumption and only slight noise production. Embodiments not otherwise shown in the drawings are distinguished in that therein, the blowing or blast pressure and/or the suction pressure can be set, in particular, automatically, in accordance with the predetermined weight per unit of surface area of the sheets. Embodiments are also possible wherein individual rows of blow or blast openings 4.8, extending in the feeding direction 4.17 and/or in the transverse direction 4.22, are deactivated. The first of these embodiments serves in particular for adapting the air consumption to the sheet width of the sheets which have been fed in. The latter embodiments, especially in combination with the first ones, enable adapting the distribution of pressure sources and pressure sinks to the stiffness of the sheets, so that, for example, the spaced distance between adjacent pressure sources and pressure sinks can be greater with stiffer sheets than with softer sheets. Provision may also be made for rows of air flow openings, in particular, the blow or blast openings, to be activated or deactivated in sequence with gripper bars of the conveyor system, which are moving past.

I claim:

1. A method for guiding sheets, which comprises;

guiding sheets pulled by a conveyor in a feed direction along a guide face of a sheet guiding device in a sheet processing machine;

providing the guide face with a pattern of pressure sources and pressure sinks at the guide face;

generating currents of flowing air between the guide face and a respective sheet by using the pressure sources and pressure sinks; and adapting the pattern and the currents to form an air cushion with the currents bearing the sheet at a distance from the guide face being based virtually only on an effect of viscosity of the flowing air.

2. The method according to claim 1, which includes adapting the pattern of pressure sources to provide the currents with flow course lengths being short compared to the extent of the respective sheet in the direction of a respective one of the currents.

3. The method according to claim 1, which includes providing an alternating sequence of the pressure sources and the pressure sinks in at least one direction parallel to the guide face.

4. The method according to claim 3, which includes providing the alternating sequence of the pressure sources and sinks in the feeding direction.

5. The method according to claim 1, which includes providing in the region of at least some of the pressure sinks, at least one of a prevailing atmospheric pressure and a prevailing pressure other than atmospheric pressure.

6. The method according to claim 1, which includes, in the region of at least some of the pressure sinks, actively removing air from the air cushion by suction.

7. The method according to claim 1, which includes subjecting the pressure sources to compressed air so that, at a respective one of the pressure sources, a volumetric flow in $m^3/h$ is adjusted to less than 1% of the weight per unit of surface area, in $g/m^2$ of the sheet.

8. The method according to claim 1, which includes providing an air pressure adapted to the weight per unit of surface area of the sheet in the region of a respective one of the pressure sources.

9. The method according to claim 8, which includes setting the air pressure to from 1.5 to 4 times the weight per unit of surface area of the sheet.

10. The method according to claim 8, which includes setting the air pressure to approximately twice the weight per unit of surface area of the sheet.

11. The method according to claim 1, which includes providing, in the region of a respective one of the pressure sources, an air pressure of less than approximately 50 pascals.

12. The method according to claim 1, which includes producing, in the region of a respective one of the pressure sources, an air pressure between 0.5 and approximately 5 pascals.

13. A device for guiding sheets in a sheet processing machine, comprising:

a guide face;

a conveyor pulling sheets in a feed direction along said guide face; and said guide face having a pattern of airflow openings formed therein acting as pressure sources and pressure sinks causing currents of flowing air between said guide face and a respective sheet, said pattern of airflow openings causing the air currents to form an air cushion carrying the sheet at a distance from said guide face based virtually only on an effect of viscosity of the flowing air.

14. The device according to claim 13, wherein said air flow openings are formed, in part, as blast openings for feeding air into said air cushion and, in part, as outflow openings for releasing air from said air cushion, and are disposed alternatingly in at least one direction parallel to the guide face.

15. The device according to claim 14, wherein said blast openings and said outflow openings are disposed alternatingly in a direction parallel to the sheet-feeding direction.

16. The device according to claim 14, wherein said air flow openings have a total cross-sectional area equal to less than 15% of the surface area portion of the guide face formed with said air flow openings.

17. The device according to claim 16, wherein said total cross-sectional area of said air flow openings equals between approximately 1% and approximately 10% of the portion of surface area of the guide face formed with said air flow openings.

18. The device according to claim 16, wherein said total cross-sectional area of said air flow openings equals between approximately 2% and approximately 3% of the portion of surface area of the guide face formed with said air flow openings.

19. The device according to claim 13, wherein said air flow openings are formed of at least one of holes and slits.

20. The sheet-feeding device according to claim 19, wherein said air flow openings formed as slits extend transversely to the sheet-feeding direction.

21. The device according to claim 13, wherein said air flow openings are formed as holes having a diameter of less than 15 mm.

22. The device according to claim 21, wherein said diameter is between approximately 1 mm and approximately 10 mm.

23. The device according to claim 13, wherein mutually adjacent air flow openings have a mean spacing therebetween of less than 25 mm.

24. The device according to claim 23, wherein said mean spacing between said mutually adjacent air flow openings is between approximately 5 mm and approximately 20 mm.

25. The device according to claim 13, wherein more than 30% of said air flow openings serve as blast openings, and less than 70% of said air flow openings serve as outflow openings.

26. The device according to claim 13, wherein approximately 50% of said air flow openings serve as blast openings, and approximately 50% of said air flow openings serve as outflow openings.

27. The device according to claim 13, wherein at least one of atmospheric pressure and a pressure other than atmospheric pressure prevails in the region of a respective one of said outflow openings.

28. The device according to claim 13, wherein at least some of said outflow openings are connected to a negative-pressure generator.

29. The device according to claim 13, including a device for controlling the pressure in said air cushion as a function of the weight per unit of surface area of the respective sheets.

30. The device according to claim 13, including a device for selectively deactivating at least some air flow openings disposed in one of the feeding direction and a direction transverse thereto.

31. The device according to claim 13, wherein the width of said air cushion transversely to the feeding direction is settable by activation and deactivation, respectively, of air flow openings disposed in the feeding direction.

32. The device according to claim 13, including a device for controlled activation and deactivation, respectively, of air flow openings in the region between sheets following one another in the feeding direction.

33. A sheet processing machine, comprising:

a device for guiding sheets having a guide face;

a conveyor pulling sheets in a feed direction along said guide face; and said guide face having a pattern of airflow openings formed therein acting as pressure sources and pressure sinks causing currents of flowing air between said guide face and a respective sheet, said pattern of airflow openings causing the air currents to form an air cushion carrying the sheet at a distance from said guide face based virtually only on an effect of viscosity of the flowing air.

34. The sheet processing machine according to claim 33, wherein the pressure sources and the pressure sinks are disposed alternatingly in at least one direction parallel to said guide face.

35. A sheet printing machine, comprising:

a device for guiding sheets having a guide face;

a conveyor pulling sheets in a feed direction along said guide face; and said guide face having a pattern of airflow openings formed therein acting as pressure sources and pressure sinks causing currents of flowing air between said guide face and a respective sheet, said pattern of airflow openings causing the air currents to form an air cushion carrying the sheet at a distance from said guide face based virtually only on an effect of viscosity of the flowing air.

36. A printing machine according to claim 35, wherein the pressure sources and the pressure sinks are disposed alternatingly in at least one direction parallel to the guide face.

* * * * *